United States Patent [19]

Maxwell

[11] 4,383,599

[45] May 17, 1983

[54] LATCH FOR COIN OPERATED NEWSRACK

[75] Inventor: Bradley E. Maxwell, La Habra, Calif.

[73] Assignee: The Times Mirror Company, Los Angeles, Calif.

[21] Appl. No.: 168,017

[22] Filed: Jul. 14, 1980

[51] Int. Cl.[3] ..... G07F 5/08

[52] U.S. Cl. ..... 194/54; 292/340

[58] Field of Search ..... 194/54, DIG. 15, 59; 292/340, 341.17; 49/394

[56] References Cited

U.S. PATENT DOCUMENTS 3,884,330 5/1975 Chalabian ..... 194/DIG. 15

4,076,294 2/1978 Holmberg ..... 292/340

*Primary Examiner*—Stanley H. Tollberg

*Attorney, Agent, or Firm*—Christie, Parker & Hale

[57] ABSTRACT

A latch for a coin operated newsrack is spring mounted to the door so as to permit resilient relative movement between the latch and the door when the door is pried by vandals. During normal movement of the door, springs will retain a latch bracket in fixed position on the door.

10 Claims, 3 Drawing Figures

LATCH FOR COIN OPERATED NEWSRACK

BACKGROUND OF THE INVENTION

This invention relates to coin operated newsracks and, more particularly, to an improved latch therefor.

Coin operated newsracks are generally situated at street corners and public places and are therefore subject to heavy abuse from vandals. A typical coin operated newsrack has a compartment for storage of newspapers and a door permitting access to the compartment when open and denying access to the compartment when closed. A latch is rigidly mounted on the door and a locking member or bar normally engages the latch to prevent the door from opening. A coin mechanism is adapted to disengage the latch from the locking bar so the door can be opened when a predetermined combination of coins is present. Typical newsracks are shown in Terry U.S. Pat. No. 2,925,898, Chalabian U.S. Pat. No. 3,884,330, and co-pending application Ser. No. 168,007 of Brian Marcroft filed on even date herewith.

Vandals frequently attempt to gain access to the newspaper storage compartment of a newsrack by prying or pulling open one corner of the door. Since one end of the latch remains engaged with the locking bar and the other end remains rigidly attached to the door, as the door is pried open, the latch becomes permanently deformed before it finally becomes disengaged from the locking bar. Thereafter, the latch cannot be engaged once again with the locking bar so the newsrack must be replaced.

SUMMARY OF THE INVENTION

According to the invention, a latch for a coin operated newsrack is spring mounted to the door so as to permit resilient relative movement between the latch and the door when the door is pried by vandals. As a result, the latch remains undamaged and access is denied to the vandals because the latch as a unit without deforming remains normal to the coin mechanism and does not disengage from the locking bar when the door is pried.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Figure 1:
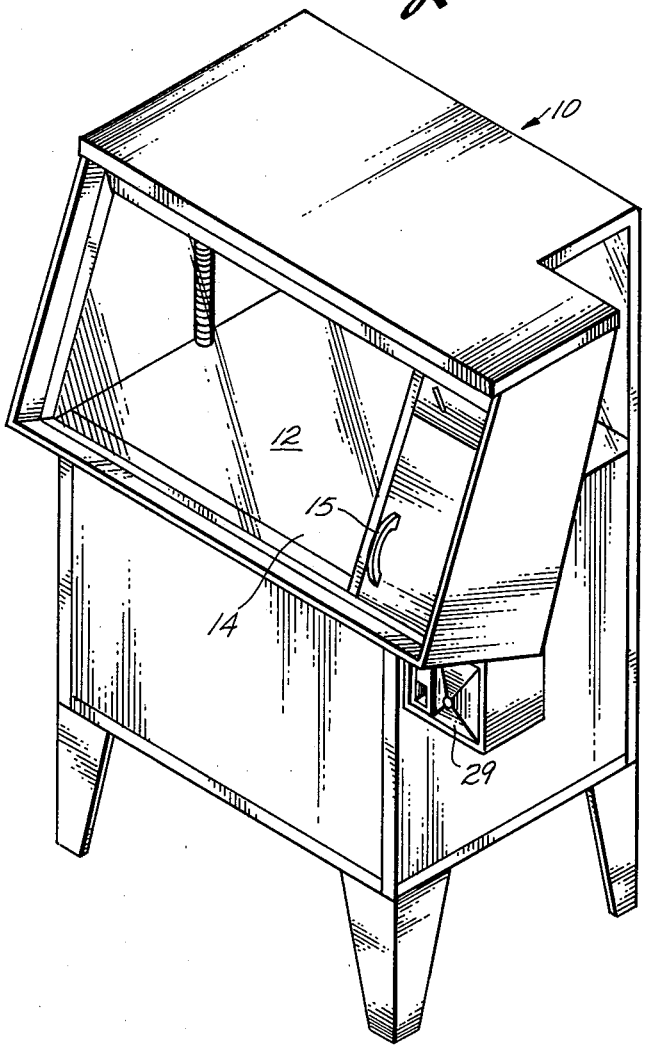
FIG. 1 is a perspective view of a coin operated newsrack.
Figure 2:
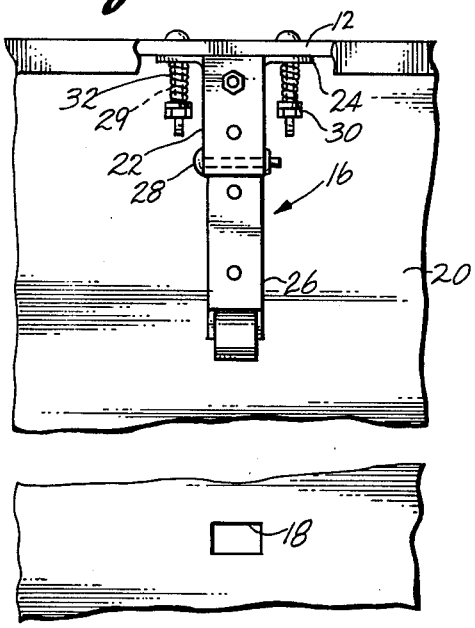
FIG. 2 is a front view of the newsrack of FIG. 1 with the door open, showing a latch mounted in accordance with the principles of the invention.
Figure 3:
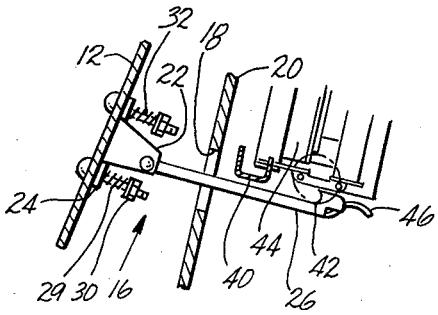
FIG. 3 is a side sectional view of a portion of the newsrack of FIG. 1 with the door closed.

In FIG. 1 a newsrack 10 has a compartment 12 for storage of newspapers. A door 14 is hinged along its upper edge for access to compartment 12. Near one side, door 14 has a handle 15. Behind the handle is a coin mechanism. The disclosure of the co-pending Marcroft application, which describes the details of newsrack 10, is incorporated herein by reference. As illustrated in FIGS. 2 and 3, a latch 16 is mounted on the inner surface of door 14 near the side thereof having handle 15 in alignment with a latch receiving opening 18 in a coin mechanism housing 20. Latch 16 is conventional except for the way it is mounted to door 14. Instead of being rigidly mounted as for example, by welding, latch 16 is spring mounted to permit resilient relative movement to between latch 16 and door 14 when door 14 is pried. Specifically, latch 16 comprises a bracket 22 on which mounting flanges 24 are formed an an arm 26, which is pivotally attached to bracket 22 by a pin 28. Flanges 24 are secured to door 14 by bolts 29 and nuts 30. Bolts 29 have in a one-piece construction non-slotted heads on the outside of door 14 and shanks extending inwardly through door 14 and flanges 24. Nuts 30 are spaced from flanges 24 and springs 32 are disposed in compression between flanges 24 and nuts 30 around the shanks of bolts 29. The heads of bolts 29 and nuts 30 comprise clamping means between which springs 32 urge flanges 24 against door 14. As illustrated by FIGS. 2 and 3, bolts 29, nuts 30, and springs 32 are arranged in two-by-two fashion above and below and on both sides of latch 16.

Although latch 16 could be employed with different types of coin mechanisms, including that disclosed in the above-referenced Terry patent, for the purposes of discussion it is assumed that the coin mechanism employed with latch 16 is of the type described in the above-referenced Chalabian patent. The disclosure of this patent is incorporated herein by reference. Arm 26 is biased by a spring (not shown) in an upwardly direction, i.e., counterclockwise as viewed in FIG. 3, toward a pivotal bracket 40 of the coin mechanism. Pivotal coin chutes 44 are biased by springs (not shown) into a closed position. Bracket 40 is biased by springs (not shown) away from housing 20. Arm 26 has an upwardly projecting tooth 42 that normally lies in the path of bracket 40. When the proper combination of coins is not present in the coin mechanism and a customer pulls on door 14, tooth 42 engages bracket 40 and pivots bracket 40 toward housing 20 and bracket 40 opens coin chutes 44. Housing 20 stops the movement of bracket 40, thereby preventing door 14 from opening. Bracket 40 thus serves as a locking bar or catch for latch 16 when bracket 40 abuts housing 20. When the proper coin combination is present in the coin mechanism, the coin or coins at the bottom of coin chutes 44 pivot a cam surface 46 of arm 26 downwardly against the force of the biasing spring as the customer pulls on door 14, thereby diverting the path of tooth 42 from bracket 40 and permitting door 14 to open.

In normal use, i.e., when door 14 is opened by pulling handle 15, springs 32 urge flanges 24 into abutment with the surface of door 12 and latch 16 is essentially mounted to door 14 in conventional fashion. When door 14 is pried. for example at the end opposite latch 16, tooth 42 engages bracket 40 and flanges 24 move away from the surface of door 14 as necessary to keep latch 16 as a unit without deforming normal to the plane of opening 18 and the coin mechanism. When prying of door 14 is stopped, springs 32 return flanges 24 into abutment with the surface of door 14. Thus, latch 16 is not deformed by prying door 14 and does not become disengaged from bracket 40, so that door 14 does not open.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, other means for spring mounting the latch could be employed, although the described means is particularly advantageous.

What is claimed is:

1. A coin operated newsrack comprising:

a compartment adapted to store newspapers;

a door permitting access to the compartment when open and denying access to the compartment when closed;

a latch having mounting flange means normally abutting the surface of the door;

means for spring mounting the latch to the door so as to permit resilient relative movement between the latch and the door when the door is pried, the spring mounting means comprising fasteners each having a shank portion passing through the door and the flange means, the shank portion being substantially longer than the combined thickness of the door and the flange means, first clamping means attached to the shank portion outside the door, second clamping means attached to the shank portion inside the door and spaced from the flange means, and a compression spring for each fastener disposed around the shank portion between the second clamping means and the flange means to bear in compression against both the second clamping means and the flange means, thereby compliantly urging the flange means into abutment with the surface of the door;

means for engaging the latch to prevent the door from opening; and a coin mechanism adapted to disengage the latch from the engaging means so the door can be opened.

2. The newsrack of claim 1, in which the fastener is a bolt having a threaded shank portion, the first clamping means is a head formed in a one-piece construction with the shank portion of the bolt, and the second clamping means is a nut threaded onto the shank portion of the bolt.

3. The newsrack of claim 2, in which the latch is spring mounted to the door near one side thereof.

4. A newsrack comprising a frame defining a newspaper storage compartment, a door pivotally mounted on the frame to open thereby permitting access to the compartment and to close thereby denying access to the compartment, a coin mechanism located in the frame behind a portion of the door, the coin mechanism having a coin transfer chute with a bottom opening for the exit of coins, means for preventing the upward movement of coins in the chute when predetermined coinage is present therein, and a catch located near the bottom opening of the chute, a latch having a pivotal arm lying under the catch and the bottom opening of the chute when the door is closed, the latch arm having an upwardly extending cam surface under the bottom opening, a hook engageable with the catch, and means for pivotally urging the latch arm toward the coin mechanism so the hook engages the catch, the cam surface being so designed as to ride on coins in the chute thereby pivoting the latch away from the coin mechanism so the hook disengages the catch when upward movement of coins in the chute is prevented by the proper coinage to permit the door to be opened, characterized in that the latch has a bracket to which the latch arm is pivotally mounted and the bracket is compliantly urged against the inside surface of the portion of the door adjacent to the coin mechanism to protect the latch against damage due to prying on the door.

5. The newsrack of claim 4, in which flange means are formed on the bracket on both sides of the latch such that the flange means are compliantly urged against the inside surface of the portion of the door and such that the flange means are free to move away from the surface of the door when pried, while returning into abutment with the surface of the door when prying is stopped.

6. The newsrack of claim 5, in which the latch arm is pivotally mounted to the bracket with a pin and is pivotally urged relative to the bracket toward the coin mechanism by spring means.

7. The newsrack of claim 4, in which the latch arm is pivotally mounted to the bracket with a pin and is pivotally urged relative to the bracket toward the coin mechanism by spring means.

8. The newsrack of claim 4, in which the bracket has vertical and horizontal compliance.

9. The newsrack of claim 5, in which the flange means has vertical and horizontal compliance.

10. The newsrack of claim 1, in which the spring mounting means comprises at least four fasteners and associated springs arranged in two-by-two fashion above and below and on both sides of the latch.

* * * * *